US009966176B2

(12) United States Patent
Nishiyama

(10) Patent No.: US 9,966,176 B2
(45) Date of Patent: May 8, 2018

(54) ELECTRONIC COMPONENT

(71) Applicant: MURATA MANUFACTURING CO., LTD., Kyoto-fu (JP)

(72) Inventor: Kenji Nishiyama, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 177 days.

(21) Appl. No.: 14/877,426

(22) Filed: Oct. 7, 2015

(65) Prior Publication Data

US 2016/0111195 A1 Apr. 21, 2016

(30) Foreign Application Priority Data

Oct. 15, 2014 (JP) ..... 2014-210610

(51) Int. Cl.
*H01F 5/00* (2006.01)
*H01F 27/28* (2006.01)
(Continued)

(52) U.S. Cl.
CPC ..... *H01F 17/0013* (2013.01); *H01F 17/04* (2013.01); *H01F 27/292* (2013.01); *H01F 27/306* (2013.01)

(58) Field of Classification Search
USPC ..... 336/200
See application file for complete search history.

(56) References Cited

U.S. PATENT DOCUMENTS

2007/0063805 A1* 3/2007 Poynton ..... H01F 17/0013 336/200
2009/0085708 A1 4/2009 Matsumoto et al.
(Continued)

FOREIGN PATENT DOCUMENTS

CN 102479611 A 5/2012
CN 103578708 A 2/2014
(Continued)

OTHER PUBLICATIONS

An Office Action; "Notice of Reasons for Rejection," issued by the Japanese Patent Office dated Apr. 4, 2017, which corresponds to Japanese Patent Application No. 2014-210610 and is related to U.S. Appl. No. 14/877,426; with English language translation.
(Continued)

*Primary Examiner* — Ronald Hinson
(74) *Attorney, Agent, or Firm* — Studebaker & Brackett PC

(57) ABSTRACT

An electronic component includes a body; a coil including a first coil conductor, a second coil conductor, and a via conductor; and an internal magnetic circuit provided on an inner peripheral side of the coil. The first coil conductor is formed of a plurality of straight portions and a plurality of arc-shaped portions and is substantially spiral shaped. A portion of the first coil conductor located furthermost toward the inner peripheral side is an arc-shaped first connection portion. The second coil conductor is formed of a plurality of straight portions and a plurality of arc-shaped portions and is substantially spiral shaped. A portion of the second coil conductor located furthermost toward the inner peripheral side is an arc-shaped second connection portion. An end of the via conductor is connected to the first connection portion and another end of the via conductor is connected to the second connection portion.

2 Claims, 8 Drawing Sheets

(51) Int. Cl.

| | |
|---|---|
| ***H01F 17/00*** | (2006.01) |
| ***H01F 17/04*** | (2006.01) |
| ***H01F 27/29*** | (2006.01) |
| ***H01F 27/30*** | (2006.01) |

(56) References Cited

U.S. PATENT DOCUMENTS

| | | | | |
|---|---|---|---|---|
| 2012/0131792 | A1 | 5/2012 | Tseng | |
| 2014/0022042 | A1 | 1/2014 | Park et al. | |
| 2015/0318104 | A1* | 11/2015 | Chang | H01F 17/0013 333/185 |

FOREIGN PATENT DOCUMENTS

| | | | |
|---|---|---|---|
| JP | 2007-214448 | A | 8/2007 |
| JP | 2009-088161 | A | 4/2009 |
| JP | 2014-022723 | A | 2/2014 |
| JP | 2014-022724 | A | 2/2014 |

OTHER PUBLICATIONS

Notification of the Second Office Action issued by the State Intellectual Property Office of the People's Republic of China dated Nov. 30, 2017, which corresponds to Chinese Patent Application No. 201510608200.X and is related to U.S. Appl. No. 14/877,426.

An Office Action; "Notice of Reasons for Rejection," issued by the Japanese Patent Office dated Nov. 28, 2017, which corresponds to Japanese Patent Application No. 2014-210610 and is related to U.S. Appl. No. 14/877,426.

* cited by examiner

ELECTRONIC COMPONENT

CROSS REFERENCE TO RELATED APPLICATION

This application claims benefit of priority to Japanese Patent Application No. 2014-210610 filed Oct. 15, 2014, the entire content of which is incorporated herein by reference.

TECHNICAL FIELD

The present disclosure relates to an electronic component and in particular relates to an electronic component having a built-in coil in which an internal magnetic circuit is provided on an inner peripheral side of the coil.

BACKGROUND

The chip device described in Japanese Unexamined Patent Application Publication No. 2014-022723 is an example of a known electronic component having a built-in coil. A coil built into an electronic component 500 of this type (hereafter referred to as an electronic component of the related art) includes two coil conductors 510 and 520 and these coil conductors 510 and 520 are connected to each other with a via conductor. In addition, as illustrated in FIG. 19, the two coil conductors 510 and 520 form a spiral shape composed of a plurality of straight portions and a plurality of arc-shaped portions connected to the two end portions of the straight portions. Furthermore, although not illustrated, an internal magnetic circuit that affects the inductance of the electronic component is provided on an inner peripheral side of the coil conductors 510 and 520.

Such electronic components having a built-in coil are installed in mobile appliances such as smartphones and are becoming increasingly smaller in size with the increasing integration of such mobile appliances. However, despite the decreasing size of electronic components having a built-in coil, the performance requirements with respect to the inductance and so forth of such an electronic component are increasing. Therefore, it is requested that the inductance inside the limited space where the coil is built into such an electronic component be made as large as possible.

SUMMARY

An object of the present disclosure is to provide an electronic component having a higher inductance than an electronic component of the related art, when the electronic components have a built-in coil and are provided with an internal magnetic circuit on an inner peripheral side of the coil.

An electronic component according to a preferred embodiment of the present disclosure includes a body composed of an insulator; a coil including a first coil conductor provided on a first plane located inside the body, a second coil conductor provided on a second plane parallel to the first plane inside the body so as to be superposed with the first coil conductor when seen from an orthogonal direction orthogonal to the first plane, and a via conductor connecting the first coil conductor and the second coil conductor to each other; and an internal magnetic circuit provided on an inner peripheral side of the coil.

The first coil conductor is substantially spiral shaped as a whole and includes a first portion, which is located furthermost toward the inner peripheral side of the first coil conductor and is substantially arc-shaped, a second portion, which has one end connected to the first portion and is substantially shaped like a straight line, a third portion, which is connected to another end of the second portion and draws a substantially semicircular arc having a larger radius than an arc drawn by the first portion, and a fourth portion, which has one end connected to the third portion, has the same length as the second portion and is substantially shaped like a straight line.

The second coil conductor is substantially spiral shaped as a whole and includes a fifth portion, which is located furthermost toward the inner peripheral side of the second coil conductor and is substantially arc-shaped, a sixth portion, which has one end connected to the fifth portion and is substantially shaped like a straight line, a seventh portion, which is connected to another end of the sixth portion and draws a substantially semicircular arc having a larger radius than an arc drawn by the fifth portion, and an eighth portion, which has one end connected to the seventh portion, has the same length as the sixth portion and is substantially shaped like a straight line.

One end of the via conductor is connected to the first portion and another end of the via conductor is connected to the fifth portion.

In the electronic component according to the preferred embodiment of the present disclosure, the substantially arc-shaped first portion located furthermost toward the inner peripheral side in the first coil conductor and the substantially arc-shaped fifth portion located furthermost toward the inner peripheral side in the second coil conductor are connected to each other by the via conductor. By providing portions to be connected to the via conductor in the substantially arc-shaped portions of the coil conductors, the area of the internal magnetic circuit located on the inner peripheral side of the coil can be made larger than in the case where portions to be connected to the via conductor are provided in substantially straight portions of the coil conductors. As a result, a higher inductance can be obtained in the electronic component according to the preferred embodiment of the present disclosure than in the electronic component of the related art.

According to the preferred embodiment of the present disclosure, a higher inductance can be obtained in an electronic component having a built-in coil and in which an internal magnetic circuit is provided on an inner peripheral side of the coil.

Other features, elements, characteristics and advantages of the present disclosure will become more apparent from the following detailed description of preferred embodiments of the present disclosure with reference to the attached drawings.

DETAILED DESCRIPTION

Configuration of Electronic Component

Figure 1:
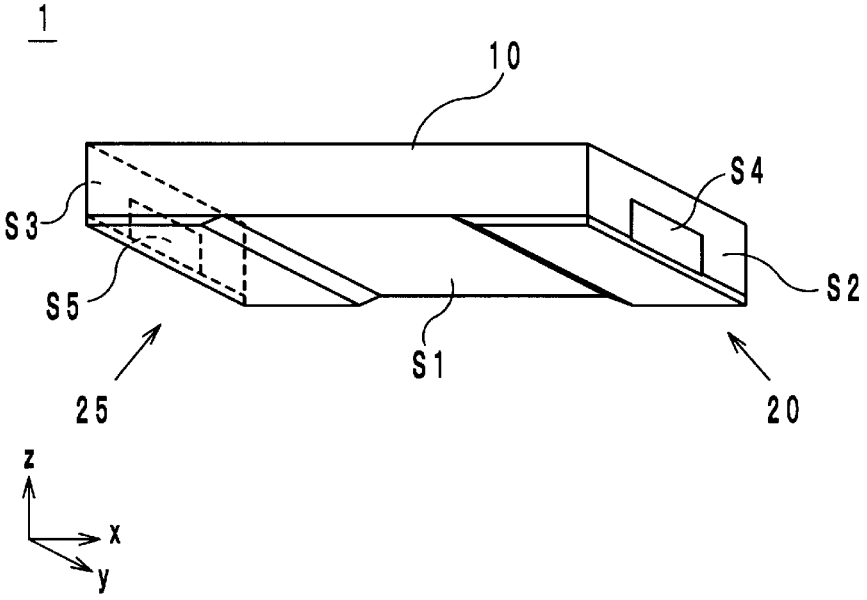
FIG. 1 is a view of the exterior of an electronic component of an embodiment.

The configuration of an electronic component 1 of an embodiment will be described while referring to FIGS. 1 to 5. Hereafter, a direction orthogonal to a bottom surface of the electronic component 1 is defined as a z-axis direction. In addition, in plan view from the z-axis direction, a direction along long edges of the electronic component 1 is defined as an x-axis direction and a direction along short edges of the electronic component 1 is defined as a y-axis direction. Furthermore, a surface on the negative side in the z-axis direction is referred to as a lower surface and a surface on the positive side in the z-axis direction is referred to an upper surface. The x axis, the y axis and the z axis are orthogonal to one another.

The electronic component 1 includes a body 10 and outer electrodes 20 and 25. In addition, a coil 30 and an internal magnetic circuit 40 are built into the electronic component 1.

As illustrated in FIG. 1, the electronic component 1 is substantially rectangular parallelepiped shaped and is a device having an L×W dimension of around 2.5×2.0 mm, 2.0×1.6 mm, 1.6×1.2 mm or 1.6×0.8 mm and a height of around 1.0 mm for example.

Figure 2:
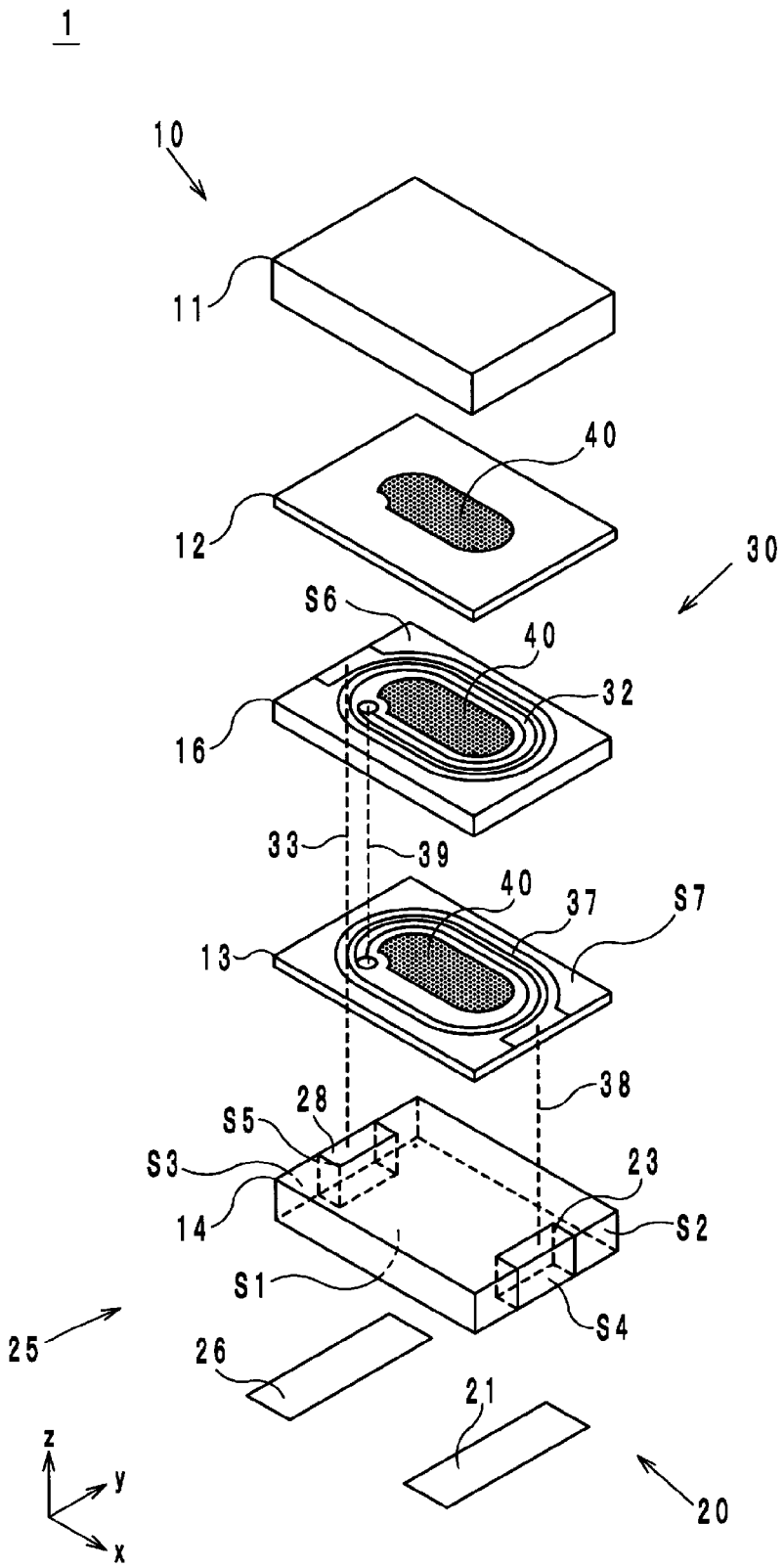
FIG. 2 is an exploded perspective view of the electronic component of the embodiment.

As illustrated in FIG. 2, the body 10 includes insulator layers 11 to 14 and an insulator substrate 16. In addition, the insulator layers 11 and 12, the insulator substrate 16, and the insulator layers 13 and 14 are stacked in this order from the positive side to the negative side in the z-axis direction in the body 10.

The insulator layers 11 and 14 are composed of a resin containing a magnetic powder for example. Examples of the magnetic powder include ferrite and metal magnetic materials (FeSiCr for example) and examples of the resin include a polyimide resin and epoxy resin. In this embodiment, considering the inductance and direct-current superimposition characteristics of the electronic component 1, the resin contains around 90 wt % or more of the magnetic powder. In addition, the insulator layer 11 is located in an end portion of the body 10 on the positive side in the z-axis direction. The insulator layer 14 is located in an end portion of the electronic component 1 on the negative side in the z-axis direction and a bottom surface S1 of the insulator layer 14, which is a surface on the negative side in the z-axis direction, is a mounting surface used when mounting the electronic component 1 on a circuit board.

The insulator layers 12 and 13 are composed of epoxy resin for example. In addition, the insulator layer 12 is located on the negative side in the z-axis direction with respect to the insulator layer 11 and the insulator layer 13 is located on the positive side in the z-axis direction with respect to the insulator layer 14. The material of the insulator layers 12 and 13 may be an insulating resin such as benzocyclobutene or an insulating inorganic material such as a glass ceramic.

The insulator substrate 16 is a printed circuit board formed by impregnating a glass fiber cloth with epoxy resin and is sandwiched between the insulator layer 12 and the insulator layer 13 in the z-axis direction. The material of the insulator substrate 16 may be an insulating resin such as benzocyclobutene or an insulating inorganic material such as a glass ceramic.

The outer electrode 20 is provided on the bottom surface S1 and a side surface S2 of the body 10 on the positive direction side in the x-axis direction when viewing the exterior of the body 10. In addition, the outer electrode 20 is formed of a bottom surface electrode 21 composed of a metal-resin composite material and a pillar-shaped electrode 23 composed of Cu. Examples of other materials that can be used for the pillar-shaped electrode 23 include Au, Ag, Pd and Ni.

Figure 3:
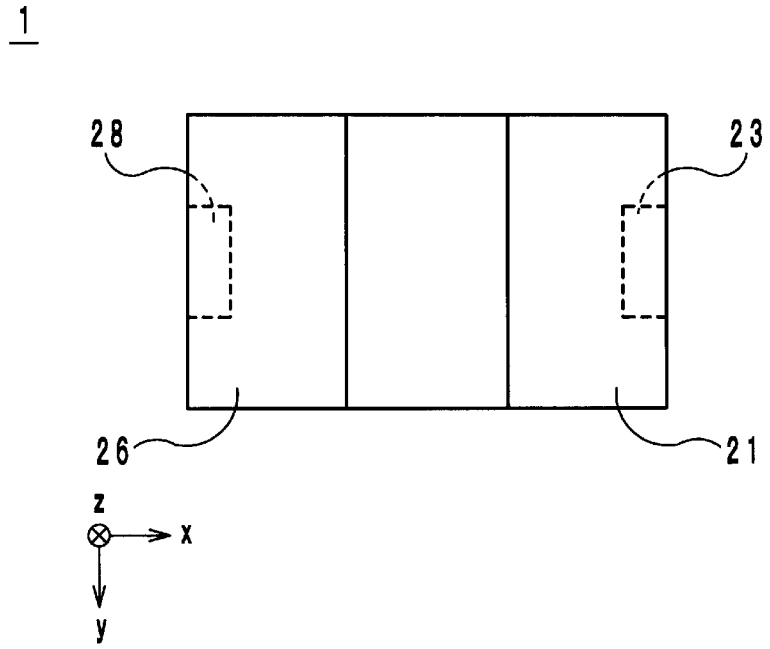
FIG. 3 is a plan view of the electronic component of the embodiment from a bottom surface side.

The bottom surface electrode 21 is a so-called resin electrode in which a low-resistance metal powder, in this embodiment Ag-coated Cu powder with an average particle diameter of around 100 nm, is dispersed in a phenol-based resin. In addition, the bottom surface electrode 21 is a flat-plate-shaped electrode provided in a region of the bottom surface S1 of the insulator layer 14 on the positive side in the x-axis direction. The bottom surface electrode 21 has a substantially rectangular shape when viewed in plan from the negative side in the z-axis direction as illustrated in FIG. 3.

As illustrated in FIG. 2, the pillar-shaped electrode 23 is provided in a region inside the body 10 on the positive side in the x-axis direction and extends so as to penetrate through the insulator layer 14 in the z-axis direction. A side surface S4 of the pillar-shaped electrode 23 on the positive side in the x-axis direction is exposed at the side surface S2 of the body 10. In addition, the pillar-shaped electrode 23 is substantially rectangular parallelepiped shaped.

The outer electrode 25 is provided on the bottom surface S1 and a side surface S3 of the body 10 on the negative direction side in the x-axis direction when viewing the exterior of the body 10. In addition, the outer electrode 25 is formed of a bottom surface electrode 26 composed of a metal-resin composite material and a pillar-shaped electrode 28 composed of Cu. Examples of other materials that can be used for the pillar-shaped electrode 28 include Au, Ag, Pd and Ni.

The bottom surface electrode 26 is a so-called resin electrode in which a low-resistance metal powder, in this embodiment Ag-coated Cu powder with an average particle diameter of around 100 nm, is dispersed in a phenol-based resin. In addition, the bottom surface electrode 26 is a flat-plate-shaped electrode provided in a region of the bottom surface S1 of the insulator layer 14 on the negative side in the x-axis direction. The bottom surface electrode 26 has a substantially rectangular shape when viewed in plan from the negative side in the z-axis direction as illustrated in FIG. 3.

As illustrated in FIG. 2, the pillar-shaped electrode 28 is provided in a region inside the body 10 on the negative side in the x-axis direction and extends so as to penetrate through the insulator layer 14 in the z-axis direction. A side surface S5 of the pillar-shaped electrode 28 on the negative side in the x-axis direction is exposed at the side surface S3 of the body 10. In addition, the pillar-shaped electrode 28 is substantially rectangular parallelepiped shaped.

The coil 30 is located inside the body 10 and is composed of a conductive material such as Au, Ag, Cu, Pd or Ni. In addition, as illustrated in FIG. 2, the coil 30 is formed of a coil conductor 32, a via conductor 33, a coil conductor 37 and via conductors 38 and 39.

Figure 4:
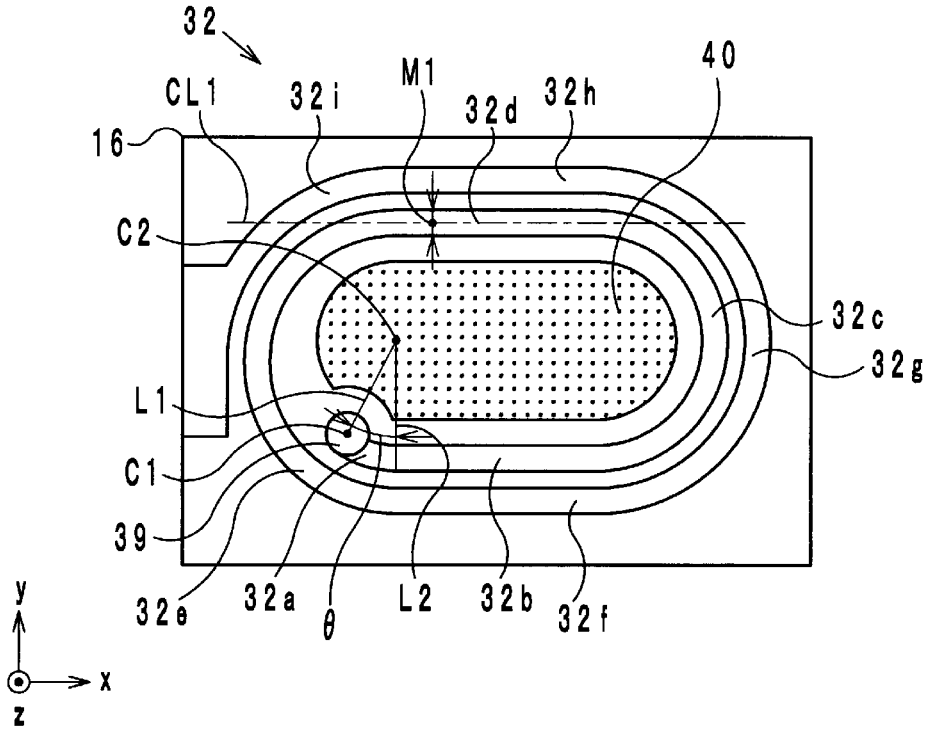
FIG. 4 is a plan view in which a coil conductor of the electronic component of the embodiment is viewed from a direction orthogonal to the bottom surface.

The coil conductor 32 is provided on an upper surface S6 of the insulator substrate 16. In addition, the coil conductor 32 is formed of a plurality of straight portions and a plurality of arc-shaped portions and is a spiral line-shaped conductor that becomes more distant from the center while looping anticlockwise in plan view from the positive side in the z-axis direction. As illustrated in FIG. 4, from the inner peripheral side, the coil conductor 32 is formed of a connection portion 32*a*, a straight portion 32*b*, a semicircular portion 32*c*, a straight portion 32*d*, a semicircular portion 32*e*, a straight portion 32*f*, a semicircular portion 32*g*, a straight portion 32*h* and a connection portion 32*i*. This will be described in more detail below.

The connection portion 32*a* is a substantially arc-shaped portion connected to the via conductor 39, which will be described later. The straight portion 32*b* is substantially shaped like a straight line and one end thereof is connected to the connection portion 32*a*. The semicircular portion 32*c* is connected to the other end of the straight portion 32*b* and has a substantially semicircular arc-like shape. In addition, the radius of the arc drawn by the semicircular portion 32*c* is larger than the radius of the arc drawn by the connection portion 32*a*. The straight portion 32*d* is substantially shaped like a straight line and one end thereof is connected to the semicircular portion 32*c*. The semicircular portion 32*e* is connected to the other end of the straight portion 32*d* and has a substantially semicircular arc-like shape. In addition, the radius of the arc drawn by the semicircular portion 32*e* is larger than the radius of the arc drawn by the semicircular portion 32*c*. The straight portion 32*f* is substantially shaped like a straight line and one end thereof is connected to the semicircular portion 32*e*. The semicircular portion 32*g* is connected to the other end of the straight portion 32*f* and has a substantially semicircular arc-like shape. In addition, the radius of the arc drawn by the semicircular portion 32*g* is larger than the radius of the arc drawn by the semicircular portion 32*e*. The straight portion 32*h* is substantially shaped like a straight line and one end thereof is connected to the semicircular portion 32*g*. The connection portion 32*i* is connected to the other end of the straight portion 32*h* and extends toward an end portion of the insulator substrate 16 on the negative side in the x-axis direction while drawing a substantially arc-like shape.

Here, the straight portions 32*b*, 32*d*, 32*f* and 32*h* have substantially the same length and extend parallel to the x axis. In addition, the line width of an end portion of the connection portion 32*i* on the negative side in the x-axis direction is larger than the line width of the rest of the connection portion 32*i* in order to facilitate connection to the via conductor 33, which will be described later.

As illustrated in FIG. 2, the via conductor 33 connects the connection portion 32*i* of the coil conductor 32 and the pillar-shaped electrode 28 to each other. Therefore, the via conductor 33 penetrates through the insulator substrate 16 and the insulator layer 13 in the z-axis direction.

Figure 5:
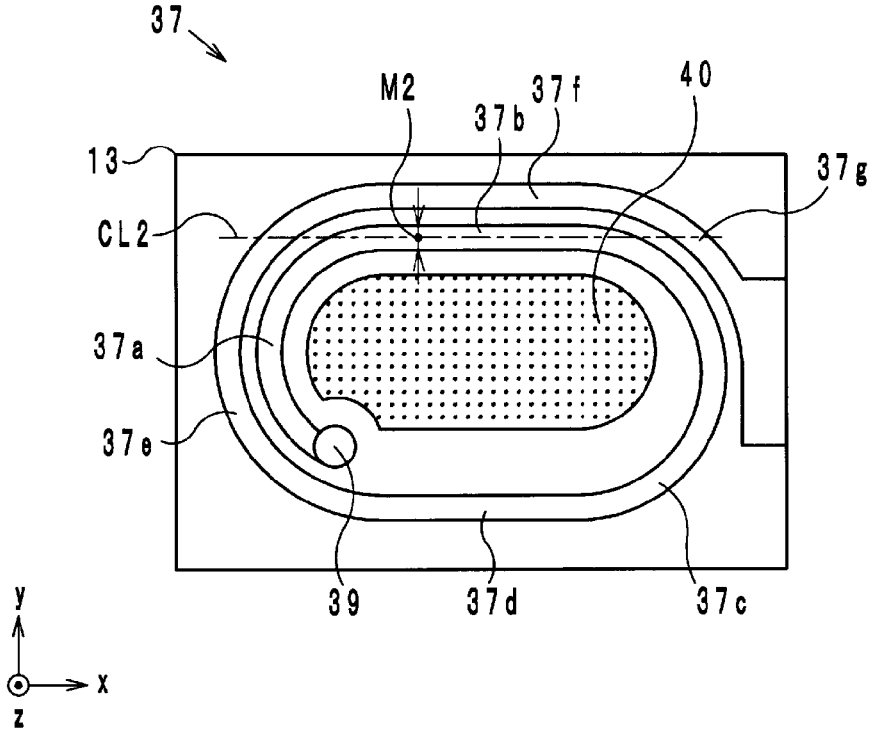
FIG. 5 is a plan view in which a coil conductor of the electronic component of the embodiment is viewed from a direction orthogonal to the bottom surface.

The coil conductor 37 is provided on the lower surface of the insulator substrate 16, that is, is provided on an upper surface S7 of the insulator layer 13. In addition, the coil conductor 37 is formed of a plurality of straight portions and a plurality of arc-shaped portions and is a spiral line-shaped conductor that becomes more distant from the center while looping clockwise in plan view from the positive side in the z-axis direction. As illustrated in FIG. 5, from the inner peripheral side, the coil conductor 37 is formed of a connection portion 37*a*, a straight portion 37*b*, a semicircular portion 37*c*, a straight portion 37*d*, a semicircular portion 37*e*, a straight portion 37*f* and a connection portion 37*g*. This will be described in more detail below.

The connection portion 37*a* is a substantially arc-shaped portion connected to the via conductor 39, which will be described later. The straight portion 37*b* is substantially shaped like a straight line and one end thereof is connected to the connection portion 37*a*. The semicircular portion 37*c* is connected to the other end of the straight portion 37*b* and has a substantially semicircular arc-like shape. In addition, the radius of the arc drawn by the semicircular portion 37*c* is larger than the radius of the arc drawn by the connection portion 37*a*. The straight portion 37*d* is substantially shaped like a straight line and one end thereof is connected to the semicircular portion 37*c*. The semicircular portion 37*e* is connected to the other end of the straight portion 37*d* and has a substantially semicircular arc-like shape. In addition, the radius of the arc drawn by the semicircular portion 37*e* is larger than the radius of the arc drawn by the semicircular portion 37*c*. The straight portion 37*f* is substantially shaped like a straight line and one end thereof is connected to the semicircular portion 37*e*. The connection portion 37*g* is connected to the other end of the straight portion 37*f* and extends toward an end portion of the insulator layer 13 on the positive side in the x-axis direction while drawing a substantially arc-like shape.

Here, the straight portions 37*b*, 37*d* and 37*f* have substantially the same length and extend parallel to the x axis. In addition, the line width of an end portion of the connection portion 37*g* on the positive side in the x-axis direction is larger than the line width of the rest of the connection portion 37*g* in order to facilitate connection to the via conductor 38, which will be described later. In addition, among the straight portions of the coil conductor 32 and the coil conductor 37, the straight portion 32*d* and the straight portion 37*d* are superposed with each other when viewed from the z-axis direction. A central axis CL1 (refer to FIG. 4) of the straight portion 32*d*, which passes through a midpoint M1 of the straight portion 32*d* in the width direction and is parallel to the x-axis direction, is aligned with a central axis CL2 (refer to FIG. 5) of the straight portion 37*b*, which passes through a midpoint M2 of the straight portion 37*b* in the width direction and is parallel to the x-axis direction, when viewed from the z-axis direction. A similar relationship exists between the straight portion 32*f* and the straight portion 37*d*, and between the straight portion 32*h* and the straight portion 37*f*.

As illustrated in FIG. 2, the via conductor 38 connects the connection portion 37*g* of the coil conductor 37 and the pillar-shaped electrode 23 to each other. Therefore, the via conductor 38 penetrates through the insulator layer 13 in the z-axis direction.

The via conductor 39 penetrates through the insulator substrate 16 in the z-axis direction and connects the connection portion 32*a* of the coil conductor 32 and the connection portion 37*a* of the coil conductor 37 to each other. The portion of the via conductor 39 that is connected to the coil conductor 32 preferable has a diameter of around 40 μm or more taking into account manufacturing variations and around 100 μm or less from the viewpoint of reducing resistance.

In addition, as illustrated in FIG. 4, an angle θ formed between a straight line L1, which connects a center point C1 of the via conductor 39 and a center point C2 of the arc drawn by the connection portion 32*a*, and a straight line L2, which connects the center point C2 and an end of the straight portion 32*b* on the negative side in the x-axis direction, is around 5° or more and 45° or less.

As illustrated in FIG. 2, the internal magnetic circuit 40 is formed of a resin containing a magnetic powder located substantially in the center inside the body 10 and on the inner peripheral side of the coil. In addition, the internal magnetic circuit 40 penetrates through the insulator layers 12 and 13 and the insulator substrate 16 in the z-axis direction and is shaped like a pillar having a substantially oval cross-sectional shape. However, as illustrated in FIG. 4 and FIG. 5, a portion of the internal magnetic circuit 40 in the vicinity of the via conductor 39 has a shape that is recessed toward the inside in order to avoid interfering with the via conductor 39. Ferrite and a metal magnetic material (FeSiCr for example) are examples of the magnetic powder and a polyimide resin and epoxy resin are examples of the resin used in the internal magnetic circuit 40. In this embodiment, considering the inductance and direct-current superimposition characteristics of the electronic component 1, the resin contains about 90 wt % or more of the magnetic powder. In addition, in order to increase the degree to which the internal magnetic circuit is filled with the magnetic powder, two types of powder having different particle sizes are mixed together.

A signal input from the outer electrode 20 or the outer electrode 25 is output from the outer electrode 25 or the outer electrode 20 via the coil 30 and in this way the thus-structured electronic component 1 functions as an inductor.

Manufacturing Method

Hereafter, a manufacturing method for the electronic component 1 of the embodiment will be described with reference to FIGS. 6 to 17. The z-axis direction used when describing the manufacturing method is a direction orthogonal to a bottom surface of the electronic component 1 manufactured using the manufacturing method.

Figure 6:
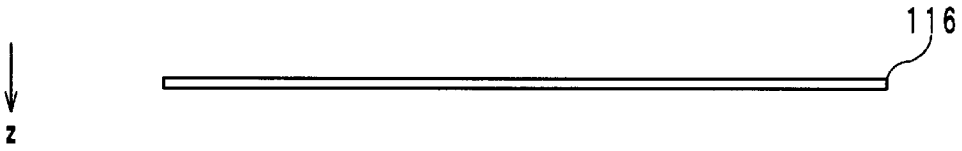
FIG. 6 illustrates a step of manufacturing the electronic component of the embodiment.
Figure 7:
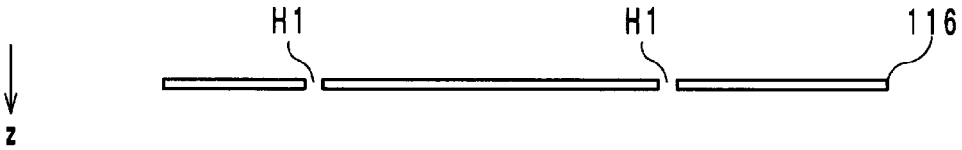
FIG. 7 illustrates a step of manufacturing the electronic component of the embodiment.

First, as illustrated in FIG. 6, a mother insulator substrate 116, which will form a plurality of insulator substrates 16, is prepared. As illustrated in FIG. 7, a plurality of through holes H1 in which the via conductor 39 is to be provided are formed in the mother insulator substrate 116 through laser processing for example.

Figure 8:
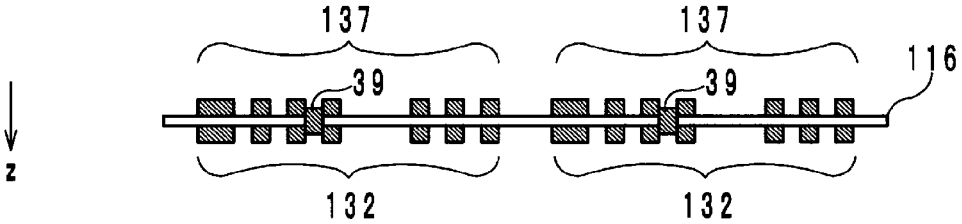
FIG. 8 illustrates a step of manufacturing the electronic component of the embodiment.

Next, the upper surface and the lower surface of the mother insulator substrate 116 in which the plurality of through holes H1 have been formed is subjected to Cu plating. At this time, the insides of the through holes are also plated and a plurality of the via conductors 39 are thus provided. Next, a plurality of conductor patterns 132 and 137 corresponding to the coil conductors 32 and 37 as illustrated in FIG. 8 are formed on the upper surface and lower surface of the mother insulator substrate 116 using photolithography.

Figure 9:
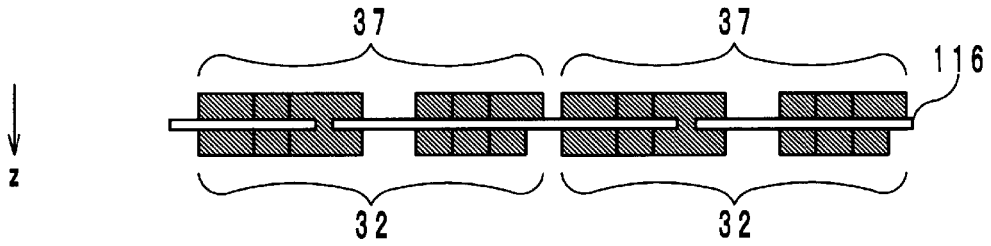
FIG. 9 illustrates a step of manufacturing the electronic component of the embodiment.

After forming the plurality of conductor patterns 132 and 137, Cu plating is again carried out and a plurality of coil conductors 32 and 37 of sufficient thickness are obtained as illustrated in FIG. 9.

Figure 10:
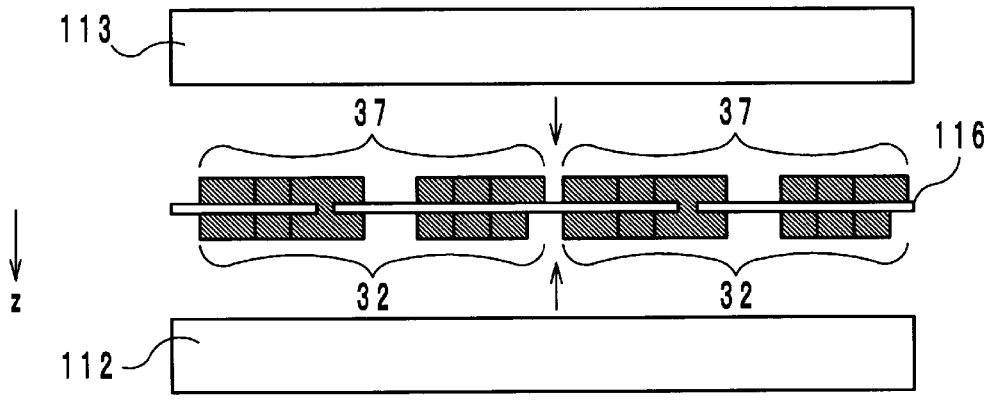
FIG. 10 illustrates a step of manufacturing the electronic component of the embodiment.

The mother insulator substrate 116 on which the plurality of coil conductors 32 and 37 have been formed is sandwiched between insulator sheets 112 and 113, which will form a plurality of insulator layers 12 and 13, from the z-axis direction as illustrated in FIG. 10.

Figure 11:
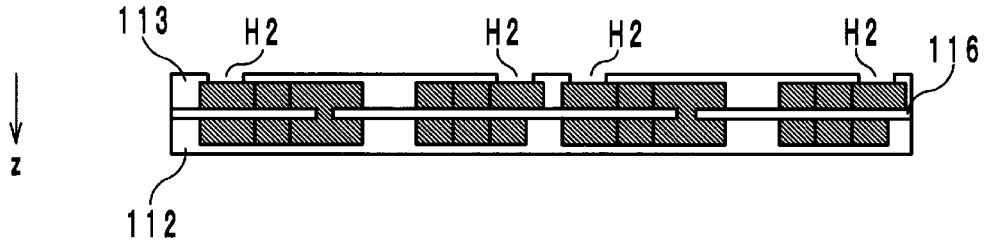
FIG. 11 illustrates a step of manufacturing the electronic component of the embodiment.

Next, as illustrated in FIG. 11, a plurality of through holes H2, in which the via conductors 33 and 38 are to be provided, are formed in the insulator sheet 113 by laser processing for example. In addition, a desmear treatment is performed in order to remove smears generated by the formation of the through holes.

Having undergone the desmear treatment, the insulator sheet 113 is first subjected to electroless Cu plating. The purpose of this electroless plating is to form a seed layer for subsequent Cu electrolytic plating. After formation of the seed layer, the insulator sheet 113 is subjected to Cu electrolytic plating. Thus, the surface of the insulator sheet 113 and the insides of the through holes are plated and a plurality of the via conductors 33 and 38 are provided.

Figure 12:
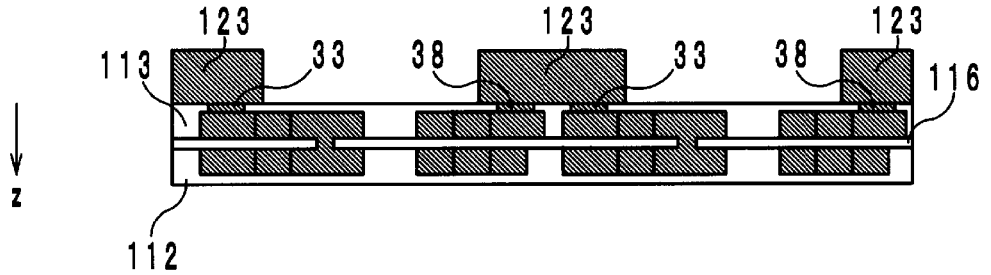
FIG. 12 illustrates a step of manufacturing the electronic component of the embodiment.

Next, as illustrated in FIG. 12, a plurality of conductor patterns 123 of sufficient thickness and corresponding to the pillar-shaped electrodes 23 and 28 are formed on the insulator sheet 113 by performing photolithography and Cu plating.

Figure 13:
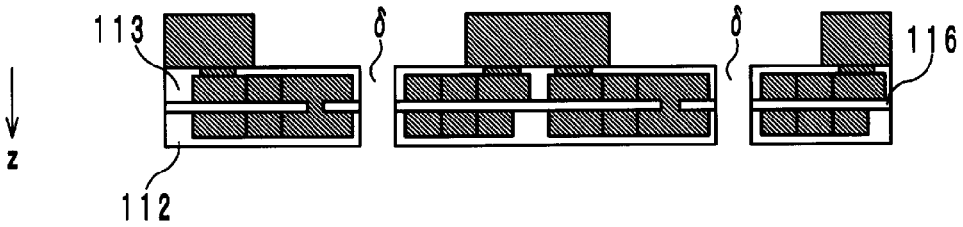
FIG. 13 illustrates a step of manufacturing the electronic component of the embodiment.

Next, as illustrated in FIG. 13, a plurality of through holes δ, which penetrate through the mother insulator substrate 116 and the insulator sheets 112 and 113 in the z-axis direction, are formed using laser processing or the like in order to allow the internal magnetic circuits 40 to be provided. Here, the positions at which the through holes δ are formed are on the inner peripheral sides of the plurality of conductors 32 and 37 provided in the mother insulator substrate 116 in the xy plane. The through holes δ may be formed by using a mask having openings corresponding to the through holes δ and performing sandblasting from the openings.

Figure 14:
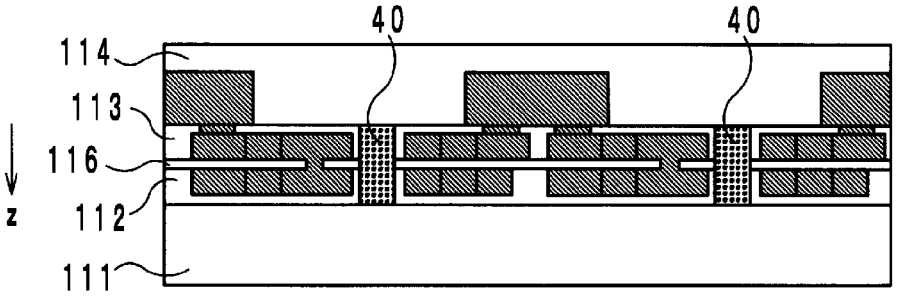
FIG. 14 illustrates a step of manufacturing the electronic component of the embodiment.

As illustrated in FIG. 14, a multilayer body in which the insulator sheet 112, the mother insulator substrate 116 and the insulator sheet 113 are stacked in this order is sandwiched between metal-magnetic-powder-containing resin sheets 111 and 114 corresponding to the insulator layers 11 and 14 in the z-axis direction and then pressure bonding is performed. At this time, the metal-magnetic-powder-containing resin sheet 111 is subjected to pressure bonding from the insulator sheet 112 side and the metal-magnetic-powder-containing resin sheet 114 is subjected to pressure bonding from the insulator sheet 113 side. Furthermore, as a result of the pressure bonding, the metal-magnetic-powder-containing resin sheets 111 and 114 enter the plurality of through holes δ and a plurality of internal magnetic circuits 40 are thus provided. Next, curing is performed by performing thermal treatment using a thermostatic chamber such as an oven.

Figure 15:
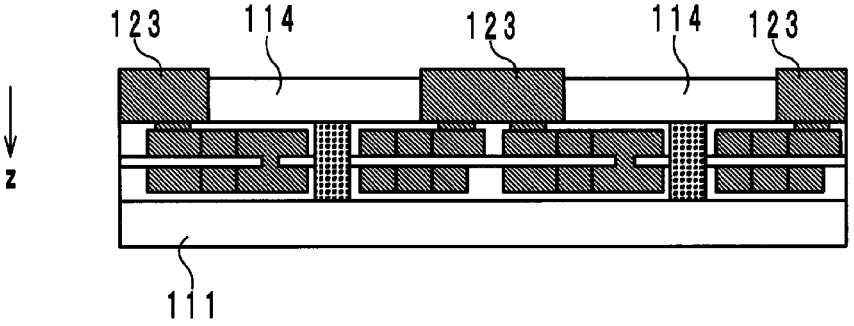
FIG. 15 illustrates a step of manufacturing the electronic component of the embodiment.

Next, the surface of the resin sheet 114 is subjected to grinding using buff grinding, lap grinding or a grinder. Thus, as illustrated in FIG. 15, conductor patterns 123 are exposed through the surface of the resin sheet 114. When subjecting the resin sheet 114 to grinding processing, the surface of the resin sheet 111 may be subjected to grinding to adjust its thickness.

Figure 16:
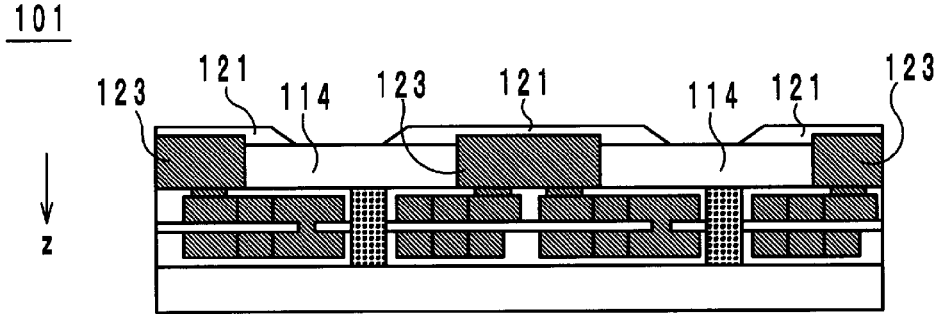
FIG. 16 illustrates a step of manufacturing the electronic component of the embodiment.

A phenol-based resin in which a Ag-coated Cu powder with an average particle diameter of around 100 nm is dispersed is applied to the conductor patterns 123 exposed through the surface of the resin sheet 114 using screen printing and then dried and a plurality of resin electrode patterns 121 corresponding to the bottom surface electrodes 21 and 26 are provided on the surface of the resin sheet 114 as illustrated in FIG. 16. Thus, a mother substrate 101, which is an agglomeration of a plurality of individual electronic components 1, is completed.

Figure 17:
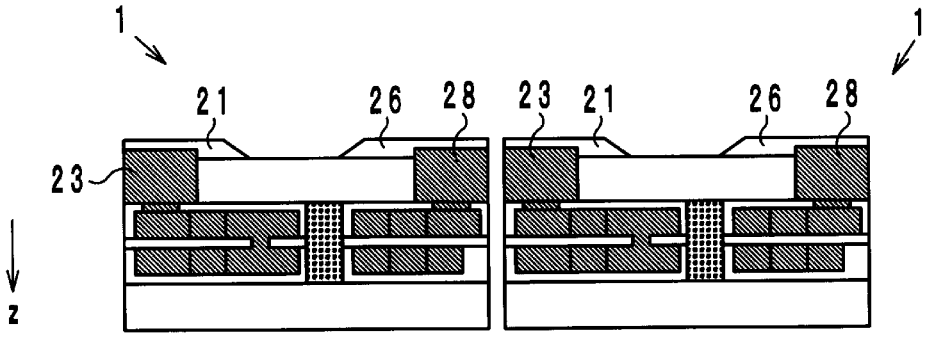
FIG. 17 illustrates a step of manufacturing the electronic component of the embodiment.

Finally, the mother substrate 101 is divided into a plurality of electronic components 1. Specifically, the mother substrate 101 is cut using a dicing saw for example and as illustrated in FIG. 17 the mother substrate 101 is divided into a plurality of electronic components 1. At this time, each conductor pattern 123 is divided into two and the resulting two pieces form the pillar-shaped electrodes 23 and 28. In addition, each resin electrode pattern 121 is also divided into two and the resulting pieces form the bottom surface electrodes 21 and 26. After dividing the mother substrate 101 into a plurality of electronic components 1, nickel and tin plating may be performed on the surfaces of the outer electrodes 20 and 25 in order to improve the wettability of the outer electrodes 20 and 25.

Effect

Figure 18:
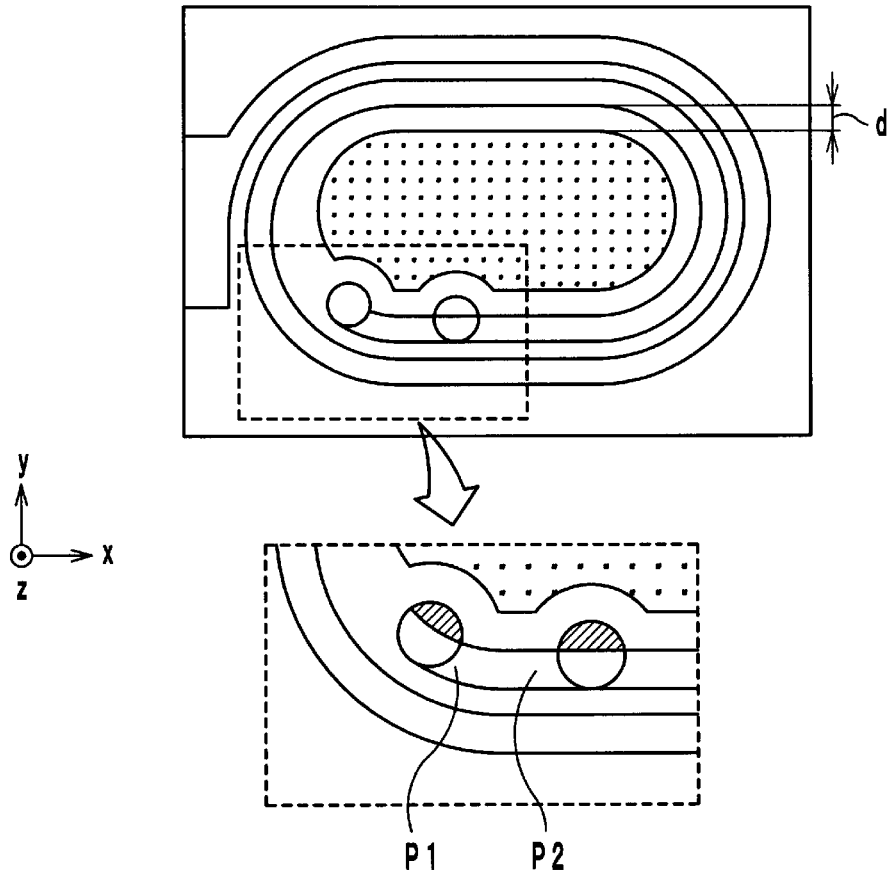
FIG. 18 is a plan view in which the position at which a coil conductor and a via conductor are connected to each other is changed and the areas where via conductors overhang toward the inner peripheral side are compared.
Figure 19:
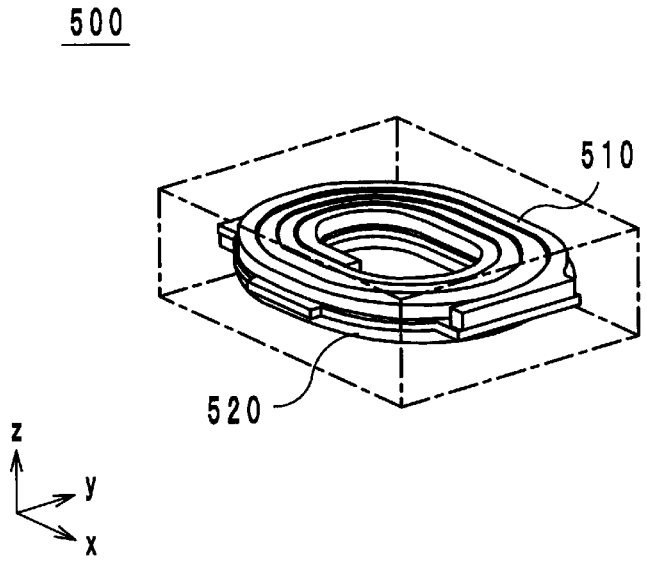
FIG. 19 PRIOR ART
FIG. 19 is a perspective view illustrating the internal configuration of an electronic component of a similar type to the chip device described in Japanese Unexamined Patent Application Publication No. 2014-022723.

In the electronic component 1, the arc-shaped connection portion 32*a* and the arc-shaped connection portion 37*a* are connected to the via conductor 39 and as a result a higher inductance can be obtained than in the electronic component of the related art. Specifically, when forming the internal magnetic circuit on the inner peripheral side of the coil, as illustrated in FIG. 18, the internal magnetic circuit is formed so as to be separated by a certain distance d from the coil conductors forming the coil. This is in order to prevent the coil conductors and the internal magnetic circuit interfering with each other due to for example manufacturing variations. In addition, the line width of a connection portion of a coil conductor where the coil conductor is connected to a via conductor is larger than the line width of the rest of the coil conductor. Therefore, arranging a connection portion of a coil conductor where the coil conductor is connected to a via conductor somewhere on the inner peripheral side of the coil conductor greatly affects the area of the internal magnetic circuit. Here, the area of a connection portion overhanging toward the inner peripheral side of the coil is reduced when the connection portion of the coil conductor where the coil conductor is connected to a via conductor is provided in a substantially arc-shaped portion P1 of the coil conductor as in the electronic component 1, compared with the case where the connection portion of the coil conductor where the coil conductor is connected to the via conductor is provided in a straight portion P2. As a result, the area of the internal magnetic circuit located on the inner peripheral side of the coil can be made larger.

Thus, in the electronic component 1, as a result of the substantially arc-shaped connection portion 32*a* and the substantially arc-shaped connection portion 37*a* being connected to the via conductor 39, a higher inductance can be obtained than in the electronic component of the related art.

In addition, in the electronic component 1, as illustrated in FIG. 4, an angle θ formed between a straight line L1, which connects the center point C1 of the via conductor 39 and the center point C2 of the arc formed by the connection portion 32*a*, and a straight line L2, which connects the center point C2 and an end of the straight portion 32*b* on the negative side in the x-axis direction, is around 5° or more and 45° or less. By arranging the position at which the coil conductor 32 and the via conductor 39 are connected to each other in this way, the area of the internal magnetic circuit can be made to be around 95% to 100% of the maximum area of the internal magnetic circuit 40. The area of the internal magnetic circuit 40 is reflected in the inductance of the electronic component 1.

In addition, the above-described effect becomes more significant the smaller the electronic component 1 becomes. Specifically, when the electronic component 1 is made smaller, the area on the inner peripheral side of the coil also becomes smaller. However, considering electrical resistance and so forth, the area of a connection portion where a via conductor and a coil conductor are connected to each other cannot be made smaller. Therefore, when the electronic component 1 is reduced in size, the ratio of the area of a portion where a via conductor and a coil conductor are connected to each other with respect to the area on the inner peripheral side of the coil is increased. As a result, the effect in which an area of a connection portion, where a via conductor and a coil conductor are connected to each other, overhanging toward the inner peripheral side of the coil being decreased by adjusting the position of the connection portion and in which the area of the internal magnetic circuit is thereby increased becomes more significant as the electronic component 1 is reduced in size.

Other Embodiments

An electronic component according to the present disclosure is not limited to the above-described embodiment and can be modified in various ways within the scope of the gist of the disclosure. For example, the number of turns of the coil and the shapes and positions of the pillar-shaped electrodes and bottom surface electrodes may be appropriately chosen.

As described above, the present disclosure is excellent in that a higher inductance can be obtained in an electronic component having a built-in coil and in which an internal magnetic circuit is provided on an inner peripheral side of the coil.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component comprising:

a body composed of an insulator;

a coil including a first coil conductor provided on a first plane located inside the body, a second coil conductor provided on a second plane parallel to the first plane inside the body so as to be superposed with the first coil conductor when seen from an orthogonal direction orthogonal to the first plane, and a via conductor connecting the first coil conductor and the second coil conductor to each other; and an internal magnetic circuit provided on an inner peripheral side of the coil; wherein the first coil conductor is substantially spiral shaped as a whole and includes a first portion, which is located furthermost toward the inner peripheral side of the first coil conductor and is substantially arc-shaped, a second portion, which has one end connected to the first portion and is substantially shaped like a straight line, a third portion, which is connected to another end of the second portion and draws a substantially semicircular arc having a larger radius than an arc drawn by the first portion, and a fourth portion, which has one end connected to the third portion, has the same length as the second portion and is substantially shaped like a straight line, and the second coil conductor is substantially spiral shaped as a whole and includes a fifth portion, which is located furthermost toward the inner peripheral side of the second coil conductor and is substantially arc-shaped, a sixth portion, which has one end connected to the fifth portion and is substantially shaped like a straight line, a seventh portion, which is connected to another end of the sixth portion and draws a substantially semicircular arc having a larger radius than an arc drawn by the fifth portion, and an eighth portion, which has one end connected to the seventh portion, has the same length as the sixth portion and is substantially shaped like a straight line, one end of the via conductor is connected to the first portion, another end of the via conductor is connected to the fifth portion, the internal magnetic circuit has a portion recessed toward an inside of the internal magnetic circuit and having an arc shape when seen from the orthogonal direction, an angle formed between a first straight line, which connects a center point of the arc drawn by the first portion and the one end of the via conductor, and a second straight line, which connects the center point and the one end of the second portion is around 5° or more and 45° or less, and the internal magnetic circuit is separated from the first to fourth portions in the first plane, and separated from the fifth to eighth portions in the second plane, by a distance d, and an area of the internal magnetic circuit with the recess is about 95% to 100% of the maximum area of the internal magnetic while maintaining the distance d.

2. The electronic component according to claim 1, wherein the first coil conductor and the second coil conductor have a certain line width, and the substantially straight-line-shaped portions of the first coil conductor and the second coil conductor, which are superposed with each other when viewed from the orthogonal direction, have central axes that respectively pass through central points of the substantially straight-line-shaped portions in a width direction of the substantially straight-line-shaped portions and are parallel to an extension direction of the substantially straight-line-shaped portions orthogonal to the width direction, and the central axes are aligned with each other when viewed from the orthogonal direction.

* * * * *